US005832912A

United States Patent [19]

Olivarez

[11] Patent Number: 5,832,912

[45] Date of Patent: Nov. 10, 1998

[54] COVERS FOR PROTECTING THE LIMBS OF A COMPOUND BOW

[76] Inventor: Alfonso Olivarez, 239 W. Suffolk, Dallas, Tex. 75208

[21] Appl. No.: 789,740

[22] Filed: Jan. 27, 1997

Related U.S. Application Data

[63] Continuation of Ser. No. 522,465, Aug. 31, 1995, abandoned.

[51] Int. Cl.[6] ..... F41B 5/10

[52] U.S. Cl. ..... 124/86; 124/25.6; 206/315.11

[58] Field of Search ..... 124/86, 23.1, 25.6; 150/154, 168, 163; 206/317, 315.11; D3/254, 262

[56] References Cited

U.S. PATENT DOCUMENTS

| | | | |
|---|---|---|---|
| 2,768,669 | 10/1956 | Kinnee | 206/315.11 |
| 2,968,300 | 1/1961 | Allen | 150/154 X |
| 3,253,587 | 5/1966 | Pearson | 124/23.1 |
| 4,257,464 | 3/1981 | Binney | 150/154 X |
| 4,480,774 | 11/1984 | Smith et al. | 206/317 X |
| 4,714,070 | 12/1987 | Shelton | 124/86 |
| 4,726,141 | 2/1988 | McBride et al. | 206/315.11 X |
| 4,760,944 | 8/1988 | Hughes | 124/23.1 X |
| 4,785,934 | 11/1988 | Hogle | 150/154 X |
| 4,979,488 | 12/1990 | Fenton et al. | 124/25.6 |
| 5,450,957 | 9/1995 | Erb | 206/317 X |
| 5,513,621 | 5/1996 | Vanskiver | 124/86 |

OTHER PUBLICATIONS

Advertisement for Miletron Products in Archery magazine on p. 7, Aug. 1975.

*Primary Examiner*—John A. Ricci
*Assistant Examiner*—Thomas A. Beach
*Attorney, Agent, or Firm*—W. Thomas Timmons; Timmons & Kelly

[57] ABSTRACT

A protective covering, carriage and storage device for use upon a compound bow. The device generally consists of marked upper and lower stitched cover sections designed to fit closely over the respective limb of a compound bow, including pulley devices and end portions. The sections are interconnected by a nylon webbed strap with a fastening buckle. The cover sections constitute the invention disclosed herein, called bow limb protector. The invention safeguards against damage to the compound bow limbs and mechanisms of the compound bow from environmental contaminants such as mud, dust, thorns and branches during general transportation.

4 Claims, 6 Drawing Sheets

FIG. 4
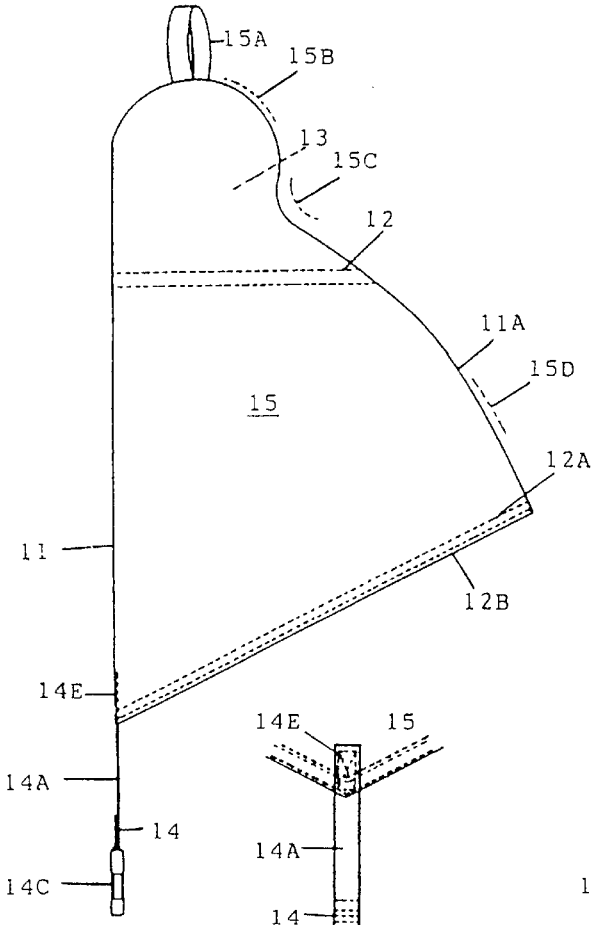
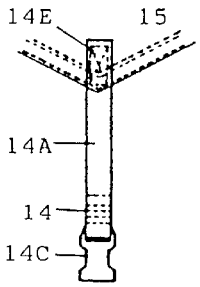
FIG. 4B
FIG. 4A
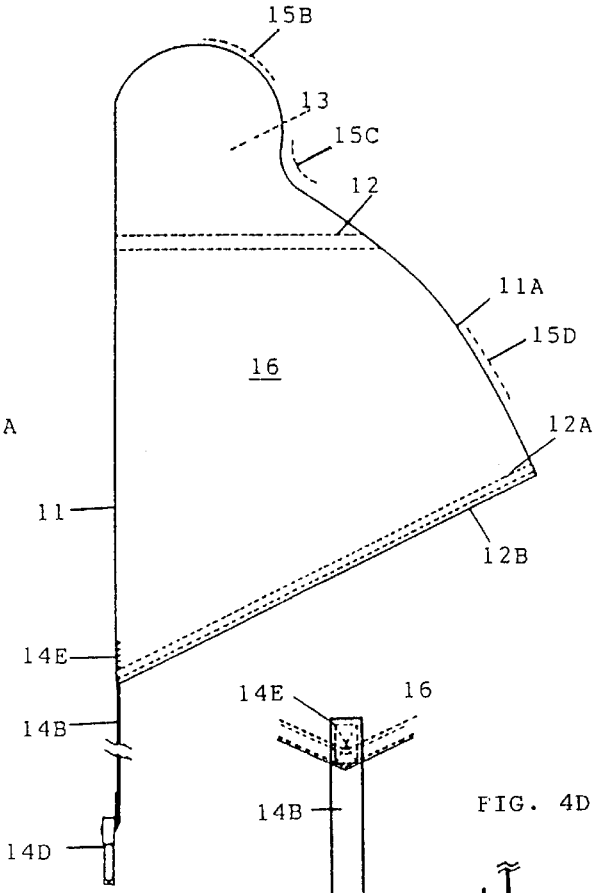
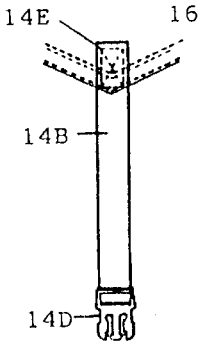
FIG. 4C
FIG. 4D
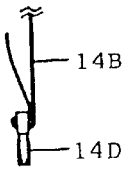

COVERS FOR PROTECTING THE LIMBS OF A COMPOUND BOW

This application is a continuation of utility application Ser. No. 08/522,465 filed Aug. 31, 1995 abandoned.

BACKGROUND OF THE INVENTION

1. Field of Investigation

The invention relates to a set of two (2) covers, consisting of and marked as an upper and a lower section, for attachment to the respective ends of a compound bow and fastened to each other by a nylon webbed strap with buckle. Addition of the invention makes the compound bow limbs generally protected from environmental damage and abuse and easier for the user to handle, carry generally use and store.

2. Background Description of the Prior Art

The compound bow is relatively recent, using a mechanical pulley and stringing arrangement to reduce user effort and strength to propel an arrow. On the other hand, a compound bow's mechanisms are delicate and uniquely open to environmental contamination and hazards; similarly, the irregular, sleek surfaced design of a compound bow makes handling of the compound bow during carriage, transportation and general use hazardous and prone to abuse of the compound bow, especially from dropping on horizontal surfaces such as the ground.

Need exists for a device to protect the limbs of a compound bow during general use and aid in storage, handling and carriage of the compound bow.

SUMMARY OF THE INVENTION

The invention has been designed to overcome the above described limitations in storage, carriage and use of compound bows while maintaining simplicity, ease of use and cost effectiveness. The invention consists of two (2) single, sewn coverage bow limb protector sections linked to each other and thus in use to the compound bow by a single generic nylon webbed strap with a sewn separation buckle. Also, the upper bow limb section contains a fabric storage loop constructed onto the outside of the upper limb protector to aid in storage of the compound bow.

In design, the bow limb sections include a back surface in each protector with a cavity extending into the body from the back surface for receiving a lateral edge surface of a limb and of the compound bow. The upper and lower bow limb coverage or protector sections, when used in conjunction with each other, thus guard the bow limbs and the end portions thereof.

BRIEF DESCRIPTION OF THE INVENTION

The bow limb protector can be constructed of any heavy duty or exterior grade protective material, although the invention contemplates using thirteen (13) ounce "all weather" canvas material; coloring of the protectors is optional and will be custom suited to the particular consumer request or application. The upper and lower sections are respectively marked for and designed to be slipped over the upper and lower limbs of a compound bow, including compound bow pulley device. FIG. 5 is a side elevational view showing the compound bow with a bow limb protector attached, embodying the present invention. FIG. 4 is a side view of the upper protector section 15 with identifying storage loop 15A sewn onto the upper protector section and a nylon webbed strap 14A sewn onto the upper protector section and a female portion of buckle 14C sewn onto the end section of the nylon webbed strap. FIG. 4A is a side view of the lower protector section 16 showing the 14B nylon webbed strap and the 14D male portion of buckle complement.

DRAWING FIGURES

FIG. 1 Exploded view of outstretched pattern of upper section and lower section, and one pattern each of inner reinforcement.

FIG. 2 A full view of inner reinforcement sewn to circular end portion of upper section and lower section.

FIG. 3 Side view of upper section folded in the center and sewn inside out enclosing storage loop in an upside down position at the circular end portion of upper section.

FIG. 3A Side view of lower section folded in the center and sewn inside out.

FIG. 4 Side view of upper section in a right side out position, exposing storage loop at the circular end portion of upper section.

FIG. 4A Frontal view of connecting strap sewn onto upper section.

FIG. 4B Side view of lower section in a right side out position.

FIG. 4C Frontal view of adjusting strap as sewn onto lower section.

FIG. 4D Partial view of lower section adjusting strap.

FIG. 5 Elevated view of upper section as used on a compound bow.

FIG. 6 A side view of upper section and lower section embodying a compound bow.

Reference Numerals in Drawings

11 rear portion of each section
11A front portion of each SeCtiOn
11B stitching for front portion of each section and storage loop
12 stitching for inner reinforcement of each section
12A stitching for hem of each section
12B hem of each section
13 inner reinforcement
14 stitching for female part of buckle
14A nylon webbed strap of upper section
14B nylon webbed strap of lower section
14C female part of separation buckle
14D male part separation buckle
14E stitching for nylon webbed strap to each section
15 upper section
15A storage loop
16 lower section
17 compound bow

DETAILED DESCRIPTION OF THE PREFERRED EMBODIMENTS

The bow limb protector, made in accordance with FIGS. 1–6, is provided for a compound bow and has a length of perimeter of approximately 44.803 inches. As shown in FIGS. 1–4A, the dimensions of the lower section described herein, although identical to the top section, differ in style from the top section only in the length of the adjusting strap, the appropriate end of the retaining strap and in the absence of a storage loop.

The configuration of closed loops of upper section 15 and lower section 16 are identical and following description, based on upper section 15, also applies to lower section 16.

Figure 2:
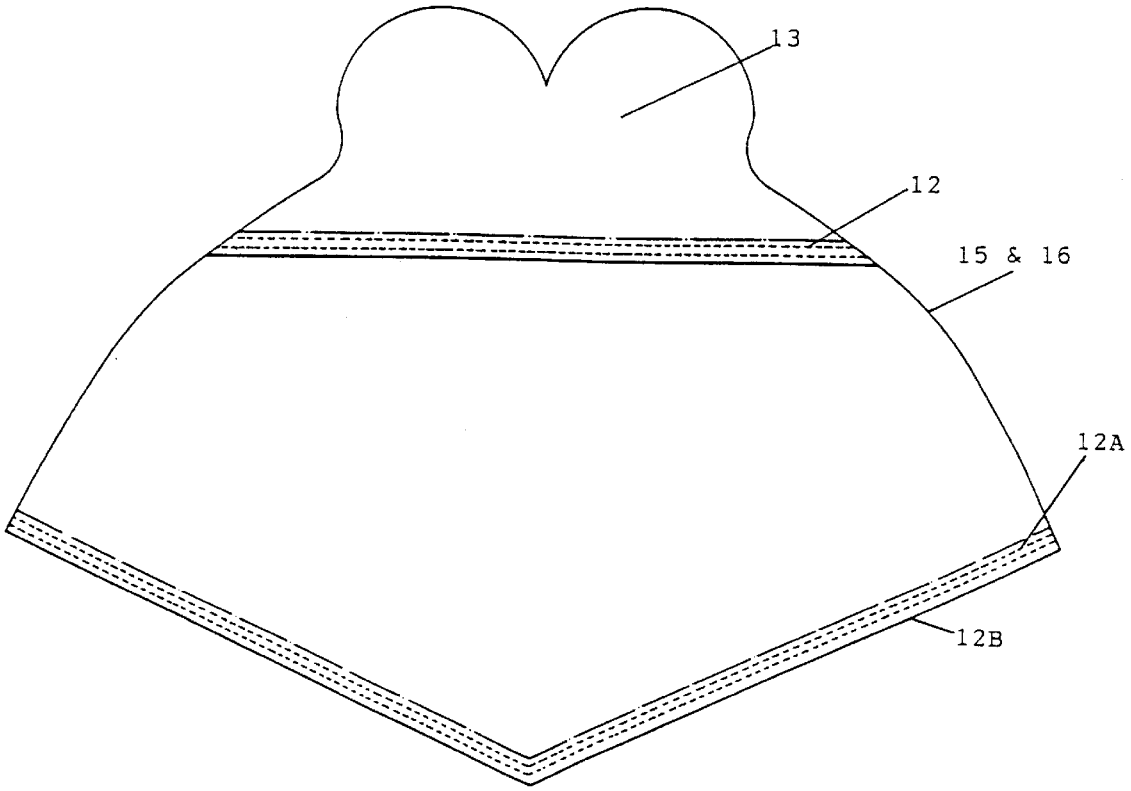
Figure 3:
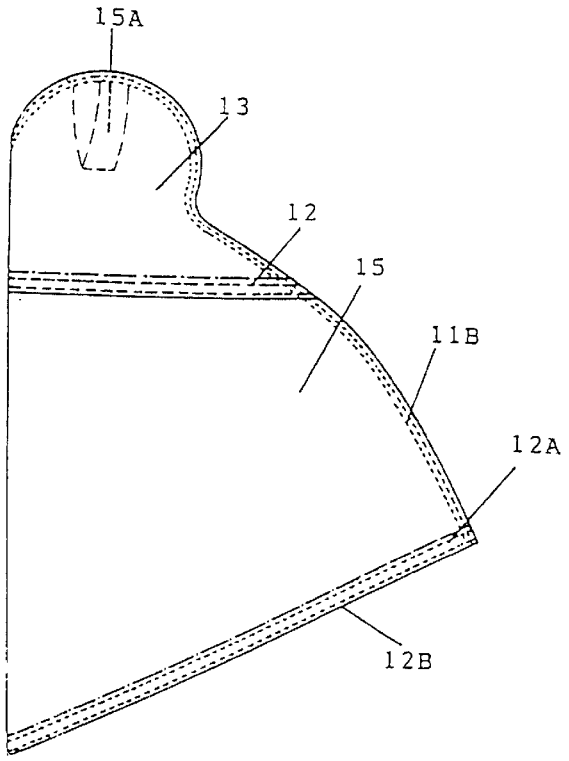
Figure 5:
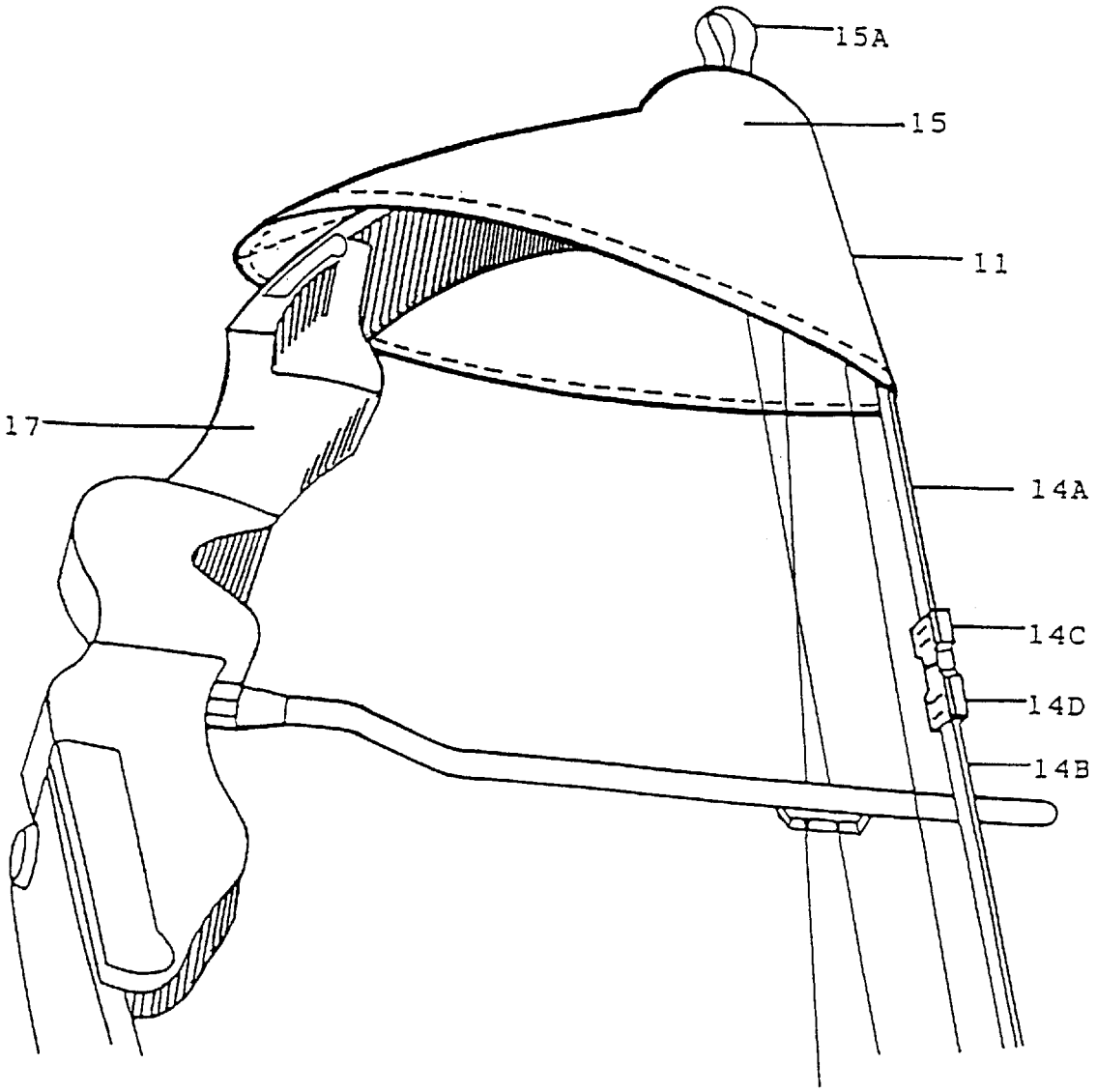
Figure 6:
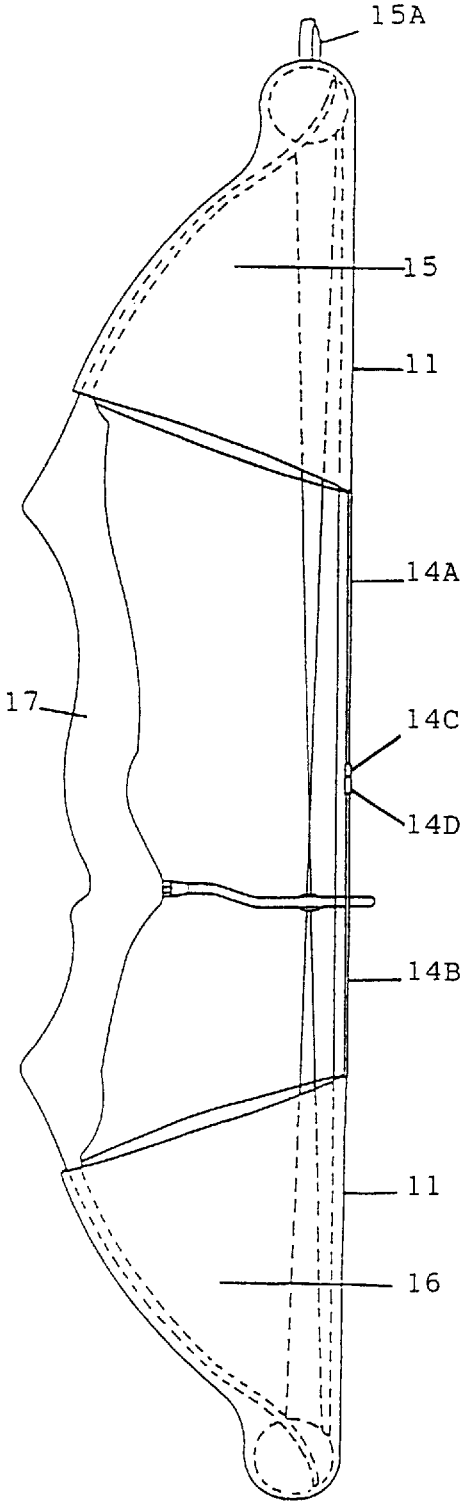

As shown in FIGS. 2–4 the end section 12B is hemmed and is the opening into which the bow limb sections are intruded in application; each end section runs straight for approximately 25.250 inches in an oblong shape making up the bottom portion of the top section and the top portion of the bottom section into which the 17 compound bow limbs are inserted for application, see FIGS. 5–6. As shown in FIGS. 4–6 the rear portion 11 has the closest proximity to the bowstring of the 17 compound bow and is substantially straight for a distance of approximately 15.50 inches per section, ending at the extreme circular end portion 15B thus constituting the rear portion of both sections.

The front portion of each section begins at its extreme circular end portion of 15B, is stitched to create a shape corresponding to the curved design of a 17 compound bow limb and created by a series of three radii per 15B, 15C and 15D, as shown in FIGS. 3–4A and described as follows:

The first radius 15B is convex and measures approximately 2.187 inches and is located at the circular end portion of each section of the invention with a radial arc of approximately 167 degrees producing a curved extreme circular end portion measuring approximately 7.250 inches in length.

Following this is 15C, the second radius measures approximately 1 inch and is concave, with an arc of approximately 58 degrees, approximately 1.250 inches in length.

The final radius is 15D is convex, measures approximately 16.60 inches forming an arc of about 20 degrees about 10.750 inches in length.

Figure 3A:
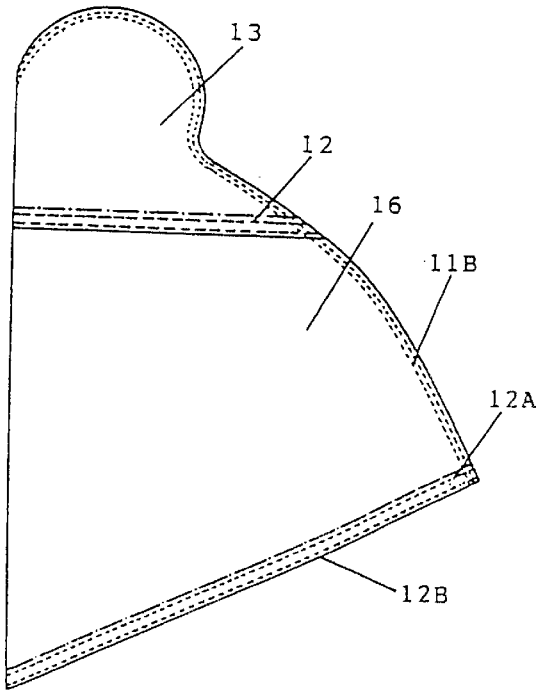

As shown in FIGS. 3–3A both upper section 15 and lower section 16 are folded in half exposing the inside area of each and matching the curved pattern of its respective half. The storage loop 15A is folded sequentially, sandwiched in an upside down position at circular end portion 15B of upper section 15. Both upper section 15 and lower section 16 are sewn double stitched 11B along curved portion 11A of each individual section.

As shown in FIG. 4 upper section 15 and lower section 16 are rightside out exposing storage loop 15A at circular end portion 15B of upper section 15.

As shown in FIGS. 4–6, upper section 15 is held to lower section 16 and thus to the compound bow by a single nylon webbed connecting strap which includes the adjustment/separation buckle. The female end of the buckle 14C is sewn onto and between the end section 12B of the upper protector section 15 and the male end of buckle 14D is woven onto nylon webbed strap 14B sewn onto the upper edges of the end section 12B of the lower protector section 16.

The connecting strap, by its adjustment and separation buckle, creates tension onto the back section of the protector section receiving the lateral edge surface of the respective limb section of the compound bow, thus customizing the adjustment and creating the tension necessary to maintain the protector onto the body of the particular compound bow application. The female end of the buckle 14C is sewn to 14A a seven (7) inch length of a three quarter (0.75) inch wide nylon webbed strap sewn 14E to the end portion of the upper section 15. The lower section 16 is fastened to the upper section by means of the male part of the buckle, 14D which is woven on the opposite end of the nylon webbed strap 14B of the following dimensions, eighteen (18) inches length by three quarters (0.75) of an inch, and adjustable by use of the nylon webbed strap on the buckle.

The upper protector section 15 contains a storage loop FIG. 15A sequentially sewn onto the upper section, made of nylon webbing measuring ¾ (0.75) of one inch wide by approximately five (5) inches long, serving as a storage device for the compound bow.

Figure 1:
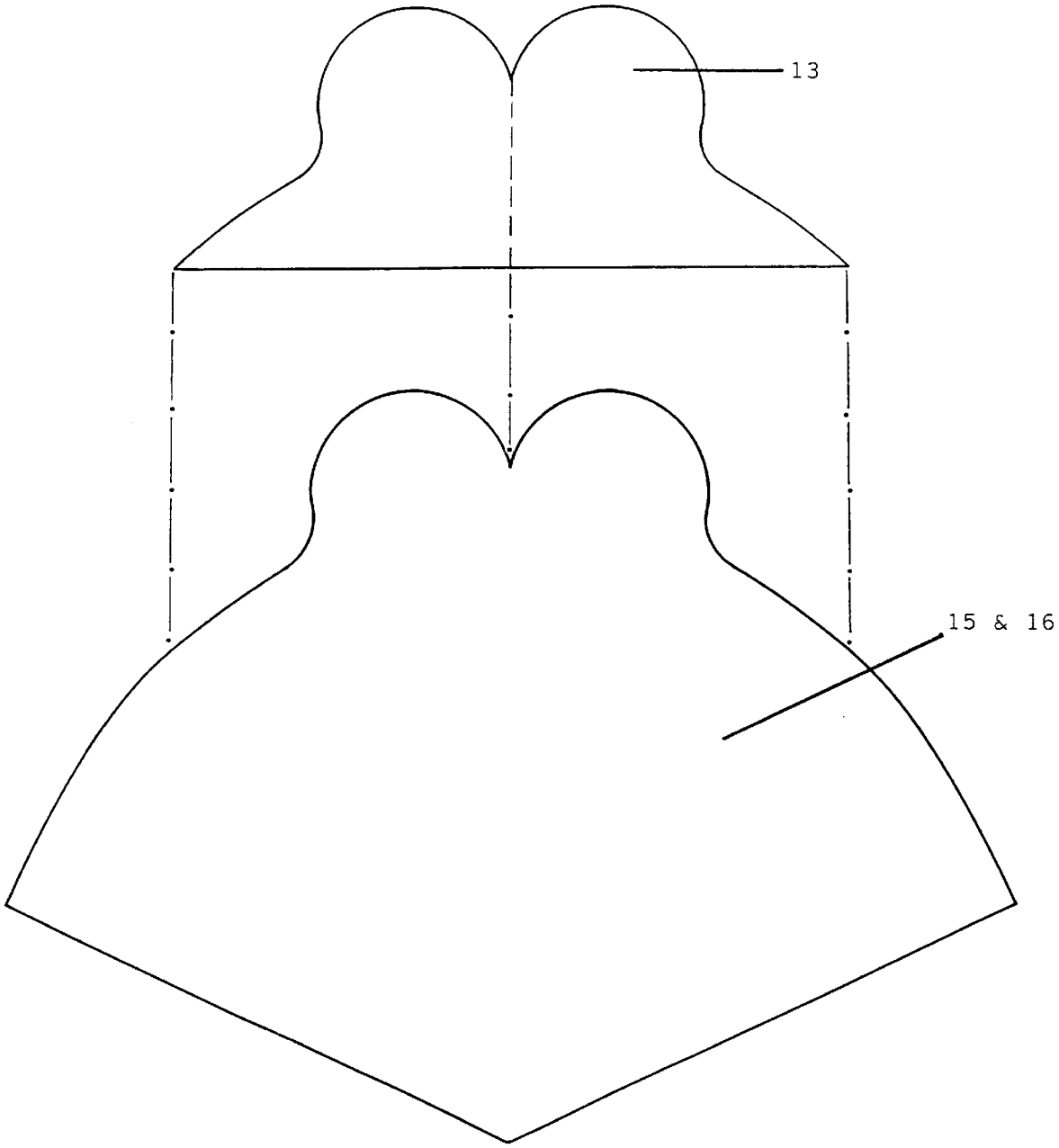

As shown in FIGS. 1–2 each section, additionally to the above, contains an inner reinforcement 13 of the same material as the cover component material, stitched onto, in the upper protector section, the inner part of the extreme upper portion thereof and, in the lower protector section, the inner part of extreme lower portion thereof.

Each reinforcement section has the following approximate dimensions: Five and three quarters (Five and ¾ths) of an inch high and sixteen and one quarter (16.25) inches wide. A reinforcement 13 is stitched onto the inside of a circular end of the upper and lower coverings. The purpose is to add structural strength to the invention and provide longer wear and overall rigidity of the protector section and of the invention itself.

The method of use is as follows: As shown in FIGS. 4–4D the user separates the sections of the invention by unfastening the single nylon webbed connecting strap by separating the generic hard plastic fastening buckle, female at 14C and male 14D. The user then slips the upper and lower cover over the appropriate bow limb. The upper and lower sections are thereafter fastened to each other by reconnecting the generic hard fastening buckle.

Various modifications of the present invention may be made by workers skilled in the art, without departing from the invention, and it is intended that the invention be limited only as set forth in the following claims:

I claim:

1. A protective device for a compound bow having a pair of resilient limbs, a pair of pulleys or cam wheels, one pulley or cam wheel attached to the distal end of each resilient limb and a bow string passing over each pulley or cam wheel and extending between the pulleys or cam wheels on the side of the pulleys or cam wheels opposite the resilient limbs, the protective device comprising in combination:

a pair of protective covers, each cover forming an opening to receive one of the pair of pulleys or cam wheels and the distal end of the associated resilient limb, wherein each cover includes a generally circular portion for covering one of the pulleys or cam wheels and a portion open to the generally circular portion, having one generally straight edge extending from one edge of the opening to the generally circular portion for substantially aligning with the portion of the bow string extending between the pulleys or cam wheels, a generally curved edge extending from the opposite edge of the opening to the generally circular portion for substantially aligning with the respective resilient limb, wherein the protective cover forms a bow receiving opening connecting the end of the generally straight edge opposite the opening to the generally circular portion to the end of the generally curved edge opposite the opening to the generally circular portion.

2. A protective device according to claim 1 further including a connecting strap attached to the generally straight edges of the protective covers, wherein the connecting strap pulls the protective covers into a snug fit over the ends of the compound bow.

3. A protective device according to claim 2 wherein each protective cover further includes an inner reinforcement of the generally circular portion.

4. A protective device according to claim 1 wherein each protective cover further includes an inner reinforcement of the generally circular portion.

* * * * *